US010115309B2

(12) United States Patent
Belzner et al.

(10) Patent No.: US 10,115,309 B2
(45) Date of Patent: Oct. 30, 2018

(54) METHOD FOR PROCESSING MEASUREMENT DATA OF A VEHICLE IN ORDER TO DETERMINE THE START OF A SEARCH FOR A PARKING SPACE

(71) Applicant: Bayerische Motoren Werke Aktiengesellschaft, Munich (DE)

(72) Inventors: Heidrun Belzner, Seefeld (DE); Peter Pedron, Augsburg (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 182 days.

(21) Appl. No.: 14/998,218

(22) Filed: Dec. 23, 2015

(65) Prior Publication Data

US 2016/0210860 A1 Jul. 21, 2016

Related U.S. Application Data

(63) Continuation of application No. PCT/EP2014/061633, filed on Jun. 4, 2014.

(30) Foreign Application Priority Data

Jun. 26, 2013 (DE) ..... 10 2013 212 235

(51) Int. Cl.
*G08G 1/14* (2006.01)

(52) U.S. Cl.
CPC ..... *G08G 1/147* (2013.01)

(58) Field of Classification Search
CPC ..... G08G 1/147
See application file for complete search history.

(56) References Cited

U.S. PATENT DOCUMENTS 7,936,284 B2 5/2011 Levine et al.
8,655,587 B2 2/2014 Kendal
(Continued)

FOREIGN PATENT DOCUMENTS

CN 101364324 A 2/2009
CN 102629422 A 8/2012
(Continued)

OTHER PUBLICATIONS

Chinese Office Action issued in Chinese counterpart application No. 201480036148.9 dated Aug. 3, 2016, with English translation (Twelve (12) pages).
(Continued)

*Primary Examiner* — Anne M Antonucci
(74) *Attorney, Agent, or Firm* — Crowell & Moring LLP

(57) ABSTRACT

A method for processing measurement data of a vehicle for determining the start of a search for a parking space includes acquiring journey data vectors, each containing information about a speed, position data and a time of acquisition of the speed and the position data, and establishing a feature vector at each time of acquisition of the journey data vectors, where the information about a current and a previous journey data vector is processed, and where the feature vector comprises as feature components at least one item of speed information and one item of path information. The method also includes classifying each feature vector, where a first traffic category, which represents a vehicle journey, or a second vehicle category, which represents parking space-seeking traffic, is assigned to each feature vector, and where a probability is established, which specifies the probability with which the first or the second traffic category is to be assigned to the feature vector. In addition, the method includes segmenting the feature vectors over the time profile of the established traffic categories, where there is a subdivision of the journey
(Continued)

from the start to the last acquisition of a journey data vector into two segments in accordance with the determined traffic categories of the feature vectors and the transition from one segment into the other segment represents the start of the search for a parking space.

16 Claims, 10 Drawing Sheets

(56) References Cited

U.S. PATENT DOCUMENTS

| | | | |
|---|---|---|---|
| 2011/0140922 | A1 | 6/2011 | Levy et al. |
| 2012/0161984 | A1 | 6/2012 | Amir |
| 2014/0340242 | A1 | 11/2014 | Belzner et al. |

FOREIGN PATENT DOCUMENTS

| | | | |
|---|---|---|---|
| CN | 102819965 | A | 12/2012 |
| DE | 10 2005 027 250 | A1 | 12/2006 |
| DE | 10 2009 028 024 | A1 | 2/2011 |
| DE | 10 2012 201 472 | A1 | 8/2013 |
| EP | 2 602 777 | A1 | 6/2013 |
| JP | 2001-67599 | A | 3/2001 |
| JP | 2001-344655 | A | 12/2001 |
| JP | 2010-281614 | A | 12/2010 |

OTHER PUBLICATIONS

PCT/EP2014/061633, International Search Report dated Aug. 11, 2014 (Three (3) pages).

German Search Report issued in counterpart application No. DE 10 2013 212 235.7 dated Feb. 21, 2014, with Statement of Relevancy (Five (5) pages).

| | $\mathbf{m}_1$ | $\mathbf{m}_2$ | ... | $\mathbf{m}_K$ |
|---|---|---|---|---|
| Feature 1 | $m_{1,1}$ | $m_{1,2}$ | ... | $m_{1,K}$ |
| Feature 2 | $m_{2,1}$ | $m_{2,2}$ | ... | $m_{2,K}$ |
| ⋮ | ⋮ | ⋮ | ⋱ | ⋮ |
| Feature N | $m_{N,1}$ | $m_{N,2}$ | ... | $m_{N,K}$ |

Fig.11

METHOD FOR PROCESSING MEASUREMENT DATA OF A VEHICLE IN ORDER TO DETERMINE THE START OF A SEARCH FOR A PARKING SPACE

CROSS REFERENCE TO RELATED APPLICATIONS

This application is a continuation of PCT International Application No. PCT/EP2014/061633, filed Jun. 4, 2014, which claims priority under 35 U.S.C. § 119 from German Patent Application No. 10 2013 212 235.7, filed Jun. 26, 2013, the entire disclosures of which are herein expressly incorporated by reference.

BACKGROUND AND SUMMARY OF THE INVENTION

The invention relates to a method for processing measurement data of a vehicle for determining the start of a search for a parking space.

Parking information in relation to free parking spaces is used, for example, by parking guidance systems and/or navigation instruments for navigating a vehicle searching for a parking space. Modern inner-city systems operate according to a simple principle. If the number of parking spaces and the inflow and outflow of vehicles are known, the availability of free parking spaces can easily be determined therefrom. Vehicles can be navigated to free parking spaces by way of appropriate signposting along the access roads and dynamic updating of the parking space information. Due to these principles, there are restrictions to the extent that the parking areas need to be clearly delimited and the entry and exit of the vehicles must be monitored exactly at all times. To this end, structural measures, such as e.g. barriers or other access control systems, are required.

Due to these restrictions, navigation is only possible to a small number of free parking spaces. With the required structural measures, it is conventionally only possible to integrate multistory car parks or fenced-off parking areas into a parking guidance system. However, the much greater number of parking spaces at the edge of the road or in non-surrounded parking spaces is not considered since the parking situation in public spaces is largely unknown. Only individual communities or traffic management headquarters offer information for specific areas.

For the search for free parking spaces, an identification of parking spaces along respective streets is desirable, particularly in the inner city and in densely populated areas. To this end, DE 10 2009 028 024 A1 has disclosed the practice of using parking space-seeking vehicles, such as e.g. municipal transport vehicles, such as e.g. regularly operating buses or taxis which have at least one sensor for identifying a parking space. Here, the sensor system can be based on optical and/or non-optical sensors.

Furthermore, community-based applications are known, in which the users of vehicles enter information, for example into an app, when they leave a parking space. This information is then provided to other users of the service. A disadvantage of this is that the information about available parking spaces is only as good as the information provided by the users.

There is a problem with the two described alternatives in that the information about the availability of an individual parking space is very short-lived, that is to say a free parking space is generally occupied within a very short period of time in areas with much parking space-seeking traffic, in which parking space information would be helpful.

Furthermore, under the application number 10 2012 201 472.1, the applicant has described a method for providing parking information in relation to free parking spaces, in which a knowledge database with historical data is produced from established information about available, free parking spaces. The historical data comprise statistical data about free parking spaces, in each case for predetermined streets and/or predetermined times or time intervals. A probability distribution in relation to the expected number of free parking spaces for the selected street or streets is established from the historical data and current information which is established at a given time for one or more selected streets by vehicles situated in traffic. The probability distribution represents parking information in relation to free parking spaces in the selected street or streets. The accuracy of the probability distribution depends, inter alia, on the knowledge about a so-called parking rate $\lambda_p$. The parking rate is calculated according to the equation $\lambda_p(t)=(1-P_n)\lambda(t)$, where $\lambda(t)$ represents a query rate specifying the number of queries for a parking space in time (i.e. per unit time) for a parking segment, i.e. a considered region in which parking processes are desired. $P_n$ specifies the probability of a free parking space.

Therefore, the more accurately the parking rate $\lambda_p$ is known, the more accurately the probability for a free parking space can be determined.

It is an object of the present invention to specify, on the basis of this method from the applicant, a method which can establish the start of a search for a parking space in an automated manner in order to improve the precision of determining the parking rate.

The invention may be used for processing measurement data of a vehicle for determining the start of a search for a parking space. The method described below can be performed on-board, i.e. in the vehicle which is searching for the parking space, or off-board, i.e. by a central computer to which the journey data are transmitted. Furthermore, the proposed method offers the option of performing the calculations online, i.e. in real time during the journey, or offline, i.e. subsequently after the journey.

In a first step, there is an acquisition of a number of journey data vectors, wherein each journey data vector contains information about the speed, position data and the time of acquisition of the speed and the position data. The acquisition of the number of journey data vectors takes place at a given time interval (also referred to as sampling rate below) of the order of seconds, e.g. every second or every five or ten seconds. The journey data vectors therefore follow a fixed sequence in time. The position data can be represented by GPS (global positioning system) data. The position data can be established by a GPS module of the vehicle. The speed can be established either by the speed sensor of the vehicle or from the position data and acquisition times of two successive measurements.

In a next step, there is an establishment of a feature vector at each time of acquisition of a journey data vector, wherein the information about the current and, in terms of time, previous journey data vectors are processed, wherein the feature vector comprises as feature components at least one item of speed information and one item of path information. As a result of this, the progress of the journey of the vehicle is taken into account. In this step, the values of the features are recalculated for each newly acquired journey data vector and combined in a feature vector. Therefore, a feature vector is calculated at each (measurement or acquisition) time, wherein use is made of both current and preceding journey data vectors.

In a next step, there is a classification of each feature vector, wherein each feature vector is assigned to one of two traffic categories. The first traffic category denotes the terminating traffic, wherein the driver is not searching for a parking space, while the second traffic category denotes the parking space-seeking traffic, wherein the driver is searching for a parking space. When determining the traffic category, a probability specifying the probability with which the first or the second traffic category is to be assigned to the feature vector is calculated. In this step, the produced feature vectors are considered individually and classified in relation to two traffic classes, namely a terminating traffic represented by the first traffic category and a parking space-seeking traffic represented by the second traffic category. At the end of this step, a probability specifying the probability with which a feature vector belongs to the parking space-seeking traffic and to the terminating traffic is available for each feature vector.

Finally, there is a segmentation of the feature vectors over the time profile of the established traffic categories, wherein there is a subdivision of the journey from the start to the last acquisition of a journey data vector into two segments in accordance with the determined traffic categories of the feature vectors and the transition from one segment into the other segment represents the start of the search for a parking space. The object of the segmentation is to establish on the basis of the analysis of the time profile of the classification of feature vectors that journey data vector which marks the start of searching for a parking space. The result of the segmentation is a subdivision of the journey into two segments, corresponding to the traffic categories, which forms the basis for calculating the desired information in relation to intensity and localization of the parking space-seeking traffic.

If the start of a search for a parking space is known, it can be used to calculate the probability of an available parking space in the surrounding area with greater accuracy. To this end, use can be made of e.g. the method by the applicant, described at the outset, from DE 10 2012 201 472.1. Furthermore, knowledge about the start of a search for a parking space can also be used by city planners to estimate the parking situation in individual streets or neighborhoods.

In order to keep the amount of data to be processed as low as possible, it may be expedient to undertake pre-filtering of the journey data vectors. Thus, journey data vectors can remain unconsidered in the determination of the start of the search for a parking space if the information about the speed of the journey data vector is greater than a first threshold or less than a second threshold. As a result of this, it is possible to neglect e.g. outer-city journeys and standing phases of the vehicle. The first threshold can lie e.g. between 50 km/h and 100 km/h and is, in particular, 80 km/h. By way of example, the second threshold can lie between 2 km/h and 8 km/h and is, in particular, 4 km/h.

In a further embodiment, the journey data vectors are processed within a feature window, which represents a predetermined route, for establishing a respective feature vector, wherein the feature window includes the journey data vectors from the current position or measurement to the first position or measurement which, on the traveled route, lies further back than the predetermined route. The number of journey data vectors in a feature window can therefore vary as a function of sampling rate and speed. By way of example, if the size of the feature window is 1 km, fewer journey data vectors are contained in the feature window in the case of a higher average speed over the last kilometer than in the case of a lower speed, provided a constant sampling rate is assumed.

In a further embodiment, the feature vector comprises one or more of the following feature components as feature components in addition to the speed information and the path information:

- Information about circularity of the traveled route. The circularity takes into account a typical behavior pattern in the case of parking space-seeking vehicles, whose journey route often describes a circular selection of the course (e.g. by circling around a block). Here, the reference variable is the distance of the current position from a centroid of the previously acquired path points, which emerge from the position data of the respective journey data vectors.
- Information about PCA circularity of the traveled route. Here, so-called PCA (principal component analysis) is used as an aid to determine the circularity of the course. If PCA is applied to the two-dimensional position vectors of a feature window, what is obtained in addition to the two principal components, which describe the mutually orthogonal axes with the highest variance of the individual path points, is a relative value for the portion of the overall variance of the axes.
- Information about a change in direction. Parking space-seeking vehicles often make a turning. On the basis of the current and a previous position, it is possible to calculate the journey direction in the form of an angle (0° to 359°, corresponding to the compass directions) for each journey data vector. In order to be able to calculate a meaningful value for the change of direction as the journey progresses, it is possible to form the arithmetic mean over all changes in direction. Preferably, this is carried out with normalized values.
- Information about a target inefficiency. This feature calculates the inefficiency of the course in relation to the target of the journey. The target cannot be determined on the basis of the journey data during the journey, and so this feature can only be formed at the end of the journey, once all journey data vectors are known. The position of the last journey data vector is assumed to be the target position, which represents the location of the found parking space. Therefore, this feature component can only be used in a method which is performed offline after the journey is complete.

In accordance with one embodiment, the speed information can be an arithmetic mean and/or the median of the average speeds of the journey data vectors considered for establishing a respective feature vector.

In accordance with one embodiment, the path information can be a path inefficiency, which specifies how inefficient the traveled route is by way of the ratio between the actually traveled route in view of the shortest route between the positions of two journey data vectors. The inefficiency of the course is a feature which specifies how inefficient the driven route, selected by the driver, is in view of approaching the target of the journey. This takes into account the characteristic of the classifiers (traffic classes), since vehicles which are part of the terminating traffic attempt to approach the sought target along the fastest and most efficient path, while parking space-seeking vehicles have usually already reached the target and circle around it while searching for a parking space.

Here, provision can be made for that path inefficiency which is the maximum for the processed set of journey data vectors to be processed for a feature vector as path information.

In a further embodiment, the feature vectors are normalized for the purposes of classifying each feature vector. Different feature components (abbreviated to features) have different value ranges. So that feature components with numerically higher value regions do not dominate over feature components with numerically smaller value ranges and in order to make the feature values more comparable, the features are normalized. The effect thereof is that both features with a large value range and features with a small value range are imaged onto the same value range.

In order to calculate normalized feature components, use can be made of a z-normalization, known to a person skilled in the art, in which the mean value and the standard deviation are established for each feature component and said feature components are transformed therewith.

Subsequently, it is expedient for the feature components to be reduced by vector projection, in particular by applying a principal component analysis (PCA). The principal component analysis is an unmonitored process for reducing features. It pursues the target of finding those main axes in a feature space on which the feature vectors imaged thereon achieve maximum variance.

The calculation of the probability of the classifier can then be carried out using Bayes' theorem, which is known to a person skilled in the art from e.g. [1] or [2].

In a further embodiment, the start of the search for a parking space is defined by a positive transition from the first traffic category to the second traffic category, wherein the journey data vector which is assigned to the second traffic category represents the start of the search for a parking space. The converse case, a transition from the second traffic category to the first traffic category, is referred to as a negative transition. In the ideal case, a positive transition occurs at most once during a journey. However, reality shows that a number of positive transitions may occur during a journey. The start of the search for a parking space can then be established using the following alternatives:

In a first alternative, the last positive transition in terms of time from the first classifier to the second classifier is selected as start of the search for a parking space as long as the classification result of the subsequent journey data vectors constantly comprises the second classifier. After a negative transition, the journey data vector marking the start of the search for a parking space is discarded such that, from this time on, no acquired start of the search is present anymore.

In a second alternative, the last positive transition in terms of time from the first classifier to the second classifier is selected as start of the search for a parking space as long as the classification result of the subsequent journey data vectors constantly comprises the second traffic category for a predetermined journey route. This segmentation alternative extends the first alternative with a distance criterion. Here, an established journey data vector is not forgotten immediately after a negative transition, but rather is maintained for a certain distance after the negative transition. If a further positive transition is found within said distance, it is ignored and the journey data vector established earlier is maintained. If no positive transition is found, the earlier journey data vector marking the start of the search for a parking space is forgotten at the end of the route after the negative transition.

In a third alternative, the start of the search for a parking space is established on the basis of an integral of the profile of the probability over the traveled route. In this third alternative, it is not only the hard decision as to whether or not a feature vector constitutes parking space-seeking traffic that is used to establish the start of the search, but also the reliability with which the decision was made. If no start of the search is present and a positive transition is acquired with a new journey data vector, the integral of the profile of the so-called a posteriori probability is continuously calculated over the traveled path. If the result of the integral calculation is negative, the previously established journey data vector is discarded.

The invention furthermore creates a computer program product, which can be loaded directly into the internal memory of a digital computer or computer system, e.g. a computer of a vehicle or a central computer, and comprises software code portions by means of which the steps in accordance with one of the preceding claims are executed when the product runs on the computer.

Below, the invention will be explained in more detail on the basis of an exemplary embodiment in the drawing. In detail:

Other objects, advantages and novel features of the present invention will become apparent from the following detailed description of one or more preferred embodiments when considered in conjunction with the accompanying drawings.

BRIEF DESCRIPTION OF THE DRAWINGS

FIG. 11 shows a table with a training matrix;

DETAILED DESCRIPTION OF THE DRAWINGS

The proposed method, which is described in detail below, renders it possible to determine the proportion of a car journey that was used for searching for a parking space in order to determine information about an implemented search for a parking space, such as e.g. the time which effectively elapsed until a parking space was found or the journey traveled during the search for a parking space or the location or the region in which a parking space was sought. From this, the method enables, in particular, the determination of the start of the search for a parking space during a car journey.

The method can be performed by a computing unit in the vehicle (i.e. on-board) or by a central computing unit outside of the vehicle (i.e. off-board). The starting point for the method is formed by so-called journey data vectors $x_i$ (i=1 . . . N) of a journey of the vehicle. The journey data vectors $x_i$ are e.g. established by the vehicle at predetermined measurement times and are processed sequentially in a plurality of steps. If the method is performed off-board, the journey data vectors $x_i$ are preferably transmitted in real time to the central computer by means of a communication interface.

A journey is represented by countable set of N journey data vectors $[x_1; x_2; \ldots; x_N]$, where $$x_i=[t_i, v_i, p_i]. \tag{3.1}$$

Figure 1:
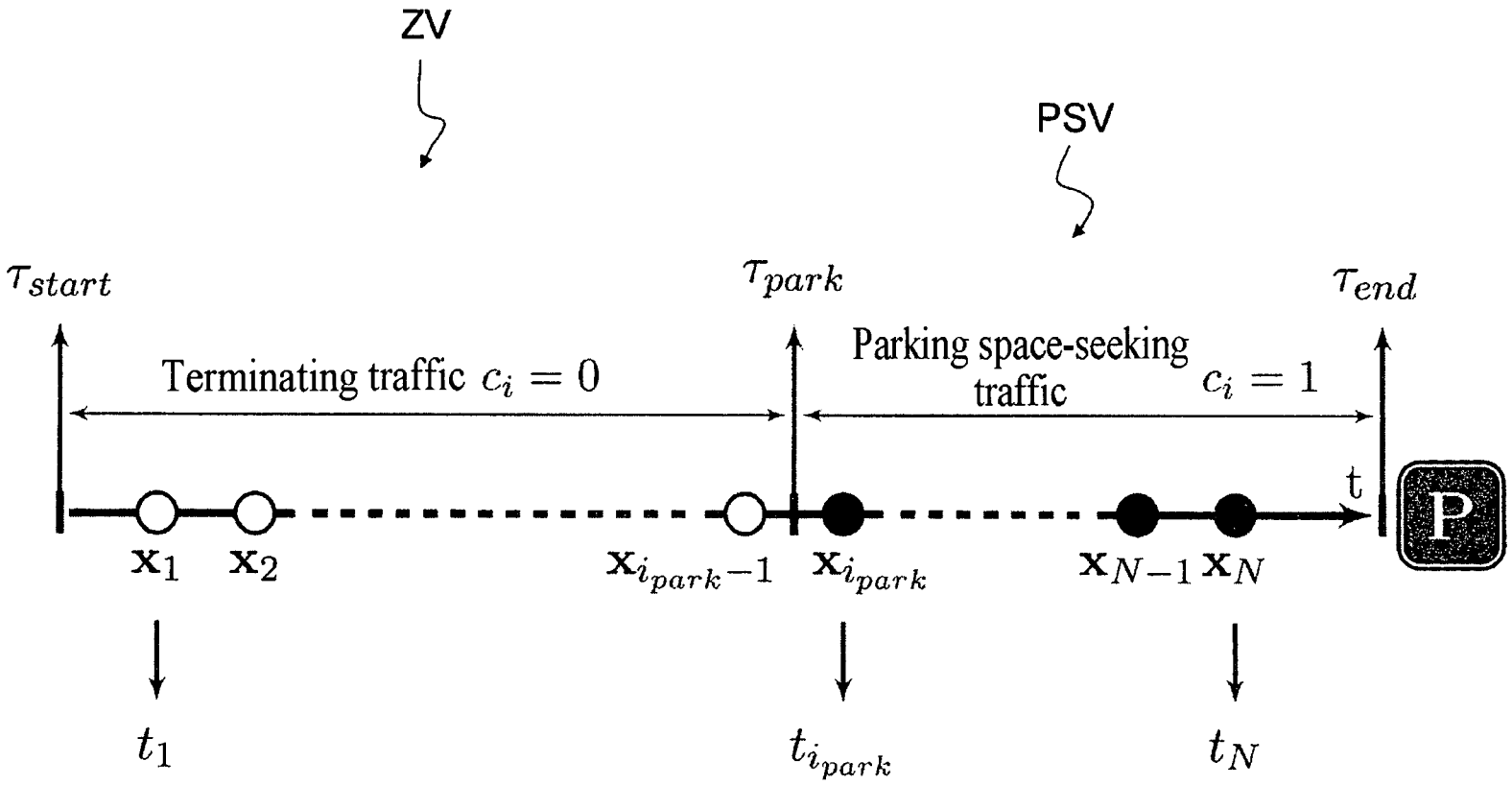
FIG. 1 shows a schematic illustration of journey data vectors ascertained successively in time.

This is depicted in an exemplary manner in FIG. 1. A journey data vector $x_i$ (Eq. 3.1) in each case consists of details about speed $v_i$ and GPS position $p_i$ at the time $t_i$ of acquisition of the journey data vector. The journey data vectors follow a fixed sequence in time since $t_i<t_{i+1}$. The GPS positions $p_i$ can be acquired by a navigation system which is either installed into the vehicle or introduced into the latter. The speed is acquired e.g. by a sensor of the vehicle and it is typically available in the vehicle in a computing unit or at a data bus.

The assumption is made that a vehicle driver only makes the decision once during a journey to search for a parking space. What may occur sometimes is that a driver begins to search in one area, aborts the search there after a certain amount of time and continues it in a different area. In this case, the last decision for searching for a parking space is assumed to be the true start of the search. Moreover, the assumption is made that each journey ends on a public parking space at the edge of the road.

In accordance with these assumptions, each journey has exactly one true time $\tau_{park}$, from which a parking space is sought. If a parking space is found directly after the decision to search for a parking space, $\tau_{park}\approx\tau_{end}$. On the basis of this time, a journey can be subdivided into two segments in according to the type of journey type $c_i$ (so-called traffic categories or traffic classes): the first segment from the beginning of the journey in this case always constitutes the so-called "terminating traffic" ZV, while the second segment corresponds to the so-called "parking space-seeking traffic" PSV. Here, the terminating traffic ZV refers to that portion of the journey during which the driver drives from a starting point $\tau_{start}$ of the journey to the region in which a parking space is sought. The driver does not seek a parking space during the terminating traffic ZV.

The assignment of the journey data vectors to the respective traffic class is implemented by way of a class label $c_i$. For the journey data vectors of a journey, the following applies:

$$c_i=0;\ \text{for } i=1; \ldots ; i_{park-1} \rightarrow \text{terminating traffic}$$

$$c_i=1;\ \text{for } i=i_{park}; \ldots ; N \rightarrow \text{parking space-seeking traffic} \tag{3.2}$$

$i_{park}$ is the first index from which the journey data vector $x_i$ is part of the parking space-seeking traffic and therefore constitutes the start of the search for a parking space. The actual time $\tau_{park}$ and the associated location of the start of the search of a journey can be approximated on the basis of $t_{i_park}$ and $p_{i_park}$ in $x_{i_park}$.

If $i_{park}$ and the journey data vectors $x_{ipark}; \ldots ; \lambda_N$ are known, the search duration $\tau_{park}$ and search distance $S_{park}$ can be approximated as follows:

$$T_{park} = t_N - t_{i_{park}} \tag{3.3}$$

$$S_{park} = \sum_{i=i_{park}}^{N-1} \delta(p_i, p_{i+1}) \tag{3.4}$$

where $\delta(\bullet,\bullet)$ denotes the distance between two GPS positions on the Earth's surface in meters. Alternatively, use can be made of a distance function which calculates the shortest path between two points in relation to a real navigation map.

The location of the search for a parking space can be specified either directly by the GPS positions of the search journey, by map matching the positions onto streets, or indirectly by specifying the so-called search centroid and mean search radius of the search journey. The basis for calculating these values is $i_{park}$. How to establish $i_{park}$; and therefore the start of the search for a parking space, is the goal of the method described in more detail below.

Figure 2:
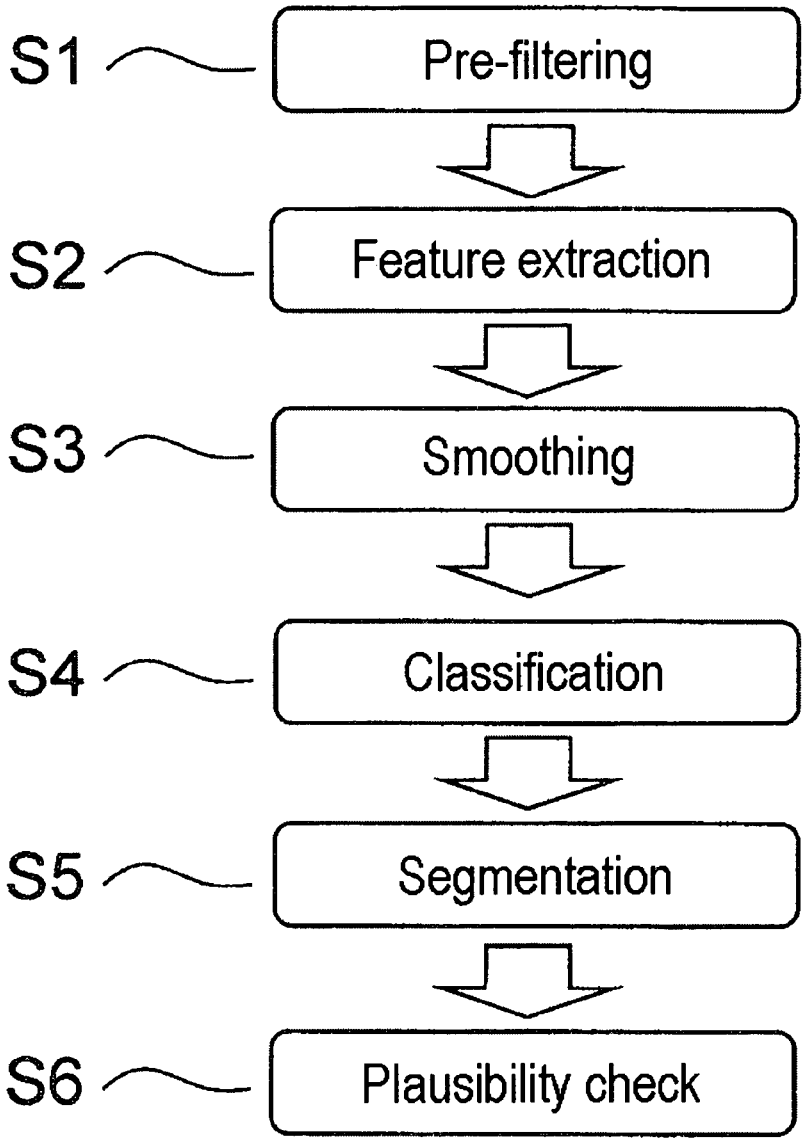
FIG. 2 shows a schematic illustration of a flow chart of the method according to the invention.

FIG. 2 shows the procedure of the method according to the invention in a flowchart.

At first, non-relevant journey data vectors are sorted out within the scope of optional pre-filtering (step S1). Subsequently, feature vectors are produced on the basis of known journey data vectors (step S2) and optionally smoothed (step S3). The classification (step S4) calculates the probability of the class affiliation to the parking-space-seeking-traffic traffic class for each feature vector. The subsequent segmentation (step S5) analyzes the classification progress and determines the final class labels $c_i$ by way of the established start of the search for the journey. At the end of the journey, the established results are optionally subject to plausibility checks (step S6).

These steps are described in more detail below.

Those journey data vectors $x_i$ which do not play any role when establishing the start of the search due to set criteria are identified and sorted out in step S1 of pre-filtering. Sorting out in this context means that the relevant journey data vector $x_i$ is not forwarded to the next step for further processing—the feature extraction. These include e.g. journeys outside of city traffic and standing phases.

A parking space at the edge of the road is typically sought in city traffic. The upper limit for the allowed speed is 80 km/h on roads in inner-city areas. Since, moreover, the assumption of parking space-seeking traffic can no longer be made at a relatively large speed, a journey data vector $x_i$ with e.g. $v_i$>80 km/h is sorted out. This threshold can also be selected to be lower or higher.

When a vehicle is standing still (for example at a traffic light or in a traffic jam), neither changes in the speed nor changes in the position can be observed. The recorded journey data vectors $x_i$ during standing phases therefore contain the same information except for the timestamp. Since information about standing phases is not relevant to any of the subsequent steps, journey data vectors $x_i$ with e.g. $v_i$<4 km/h are sorted out. The selection of this threshold is justified in that this also prevents parking processes from being acquired, the speed of which typically lies between 0-4 km/h.

The features are extracted in the subsequent step S2. In order to identify parking space-seeking vehicles, it is possible to use a low average speed, frequent turning and circling around blocks. In order to obtain information about these characteristics of the journey, a single journey data vector with the information thereof about the current speed and position does not suffice; rather the profile thereof must be taken into account.

The profile of the signal values from individual journey data forms the basis of the extraction of features presented in this section. Here, the values of the features are recalculated for every newly entering journey data vector and they are combined in a feature vector m. At each time $t_i$, a feature vector with the following feature components is calculated:

$$m_i = [\bar{v}_i, \eta_i, \kappa_i, \rho_i, \bar{\Delta}_{\phi_i}, \zeta_i] \quad \begin{array}{l} \bar{v}_i \ \ldots \text{ mean speed} \\ \eta_i \ \ldots \text{ path inefficiency} \\ \kappa_i \ \ldots \text{ circularity} \\ \rho_i \ \ldots \ PCA \text{ circularity} \\ \bar{\Delta}_{\phi_i} \ \ldots \text{ change in direction} \\ \zeta_i \ \ldots \text{ target inefficiency} \end{array} \tag{3.5}$$

Figure 3:
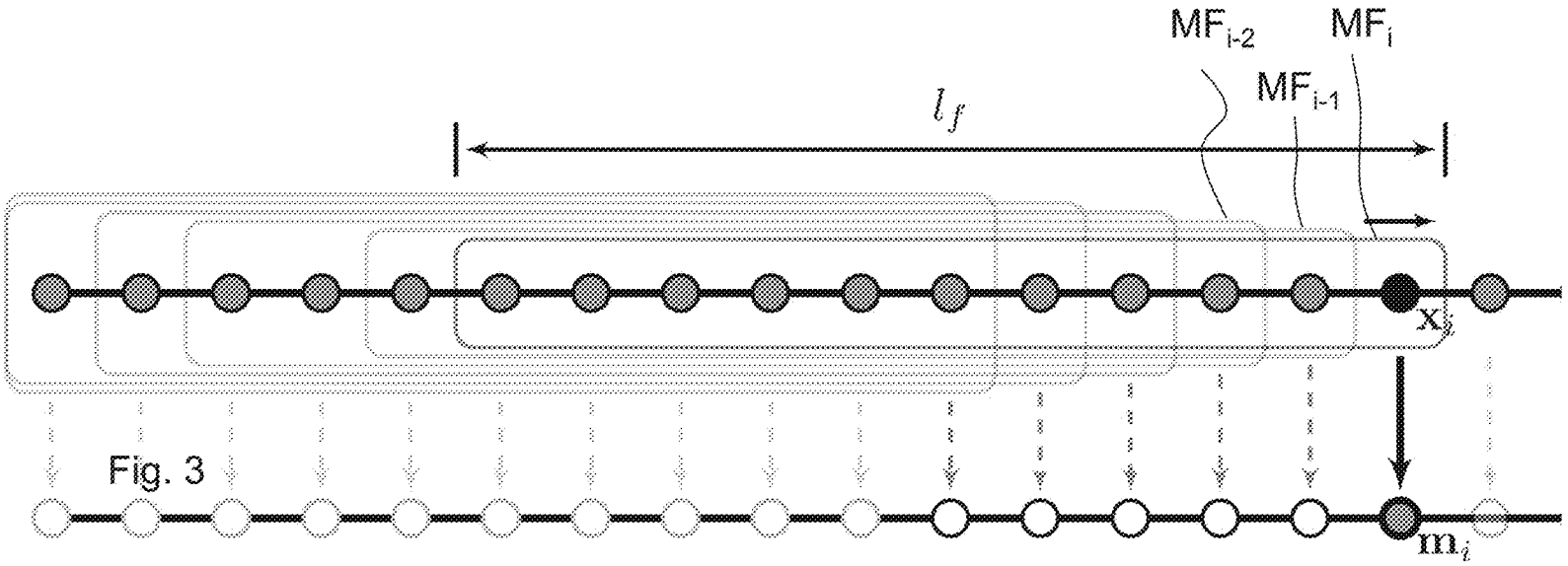
FIG. 3 shows a schematic illustration of feature windows applied to the acquired journey data vectors.

Here, it is sufficient for the average speed and path inefficiency to be taken into account as feature components (which are also referred to as features below). The accuracy of determining the start of the search for a parking space can be improved yet further by taking into account further feature components, with the accuracy only increasing to a small extent. In order to calculate the various features, both current and preceding journey data vectors are used. The journey data vectors to be taken into account for calculating features are determined on the basis of a feature window $MF_i$, which is depicted in more detail in FIG. 3.

The size $l_f$ of the feature window $MF_i$ is based on the traveled route since the majority of the constructed features analyze the route of the course. If the feature window were to orient itself on the elapsed time, the length of the journey section in a feature window $MF_i$ would vary depending on speed, and so a minimum length of the journey section would not be ensured. However, this is necessary in order to be able to compare the calculated features with one another over the course of a journey.

The feature window $MF_i$ includes the journey data vectors from the current position $x_i$ to the first position which lies further back than $l_f$ on the traveled route. The number of journey data vectors in a feature window can therefore vary as a function of sampling rate and speed. By way of example, if the size of the feature window is 1 km, fewer journey data vectors are contained in the feature window over the last kilometer in the case of a higher average speed than in the case of a lower speed, provided a constant sampling rate is assumed. Feature vectors $m_i$ can be calculated only once a distance $l_f$ from the beginning of the journey has been traveled in order to ensure the comparability between the calculated feature vectors $m_i$.

For the remainder of the course of the description, journey data vectors within a feature window, which is anchored at $x_i$, are denoted by $x_{f1}; x_{f2}; \ldots; x_{fM}$, wherein $x_{f1}$ corresponds to the oldest journey data vector and $x_{fM}$ corresponds to the most recent one. Accordingly, $x_i = x_{fM}$.

The features (feature components) calculated from journey data are described in more detail below.

Average Speed

In order to calculate the average speed v, it is not the arithmetic mean that is formed over all speed values in the feature window but rather the median. The reason for this is the robustness of the latter in relation to outliers.

$$\bar{v}_i = \text{median}\{v_{f1}, v_{f2}, \ldots, v_{fM}\} \tag{3.6}$$

As a result of the method step of pre-filtering (step S1) of the journey data vectors, this value represents the mean speed during driving phases.

Path Inefficiency

The inefficiency of the course η is a feature which specifies how inefficient the driven route selected by the driver is in view of approaching the journey target. The idea for this arises from the characteristic of the traffic classes, since vehicles, which are part of the terminating traffic, attempt to approach the sought target on the fastest and most efficient path, while vehicles seeking for a parking space have usually already reached their target and circle around it when searching for a parking space.

Figure 4:
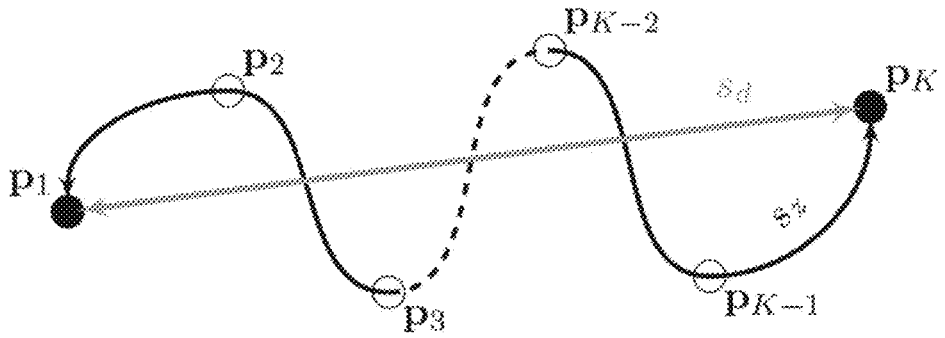
FIG. 4 shows an illustration for explaining path inefficiency.

If a journey through the waypoints $[p_1; p_2; \ldots; p_K]$ with the initial position $p_1$ and the final position $p_K$ is given, it is possible to calculate two journey measures which form the basis for calculating this feature. This is elucidated in FIG. 4 for illustration purposes.

$s_d$ is the shortest distance between $p_1$ and $p_K$, with the linear distance being used within the scope of this description. $s_Z$ represents the traveled route between $p_1$ and $p_K$. This corresponds to the length of the selected course from $p_1$ to $p_K$. $s_z \geq s_d$. The ratio of the two paths to one another provides information as to whether the selected route constitutes a direct route to the end position (efficient) or a detour (inefficient). A value for the inefficiency of the course can be calculated by:

$$\eta_k([p_1, \ldots, p_K]) = 1 - \frac{\dfrac{s_d}{\delta(p_k, p_K)}}{\dfrac{\sum_{j=k}^{K-1} \delta(p_j, p_{j+1})}{s_z}}, \ \eta_k \in [0, 1], k \in [1, K-1] \tag{3.7}$$

The traveled route $s_z$ is approximated as the sum of all partial routes between the individual waypoints. The index k specifies which waypoint in the set $[p_1; \ldots; p_K]$ is intended to serve as initial point for calculating the inefficiency. A value of $\eta_k \rightarrow 0$ allows an efficient course to be deduced, while $\eta_k \rightarrow 1$ means an inefficient course.

In order to calculate the feature, the waypoints of a feature window $[p_{f1}; p_{f2}; \ldots; p_{fM}]$ are available. The goal when calculating the feature is to establish the greatest inefficiency between the current position $p_{fM}$ and all other positions in the feature window:

$$\eta_i = \max\{\eta_k([p_{f1}, p_{f2}, \ldots, p_{fM}])\}_{k=1}^{M-1} \tag{3.8}$$

In this manner, circles and turning around, which are contained in the journey profile of a plurality of successive feature windows, have a similar effect on the feature value.

Circularity

Figure 5:
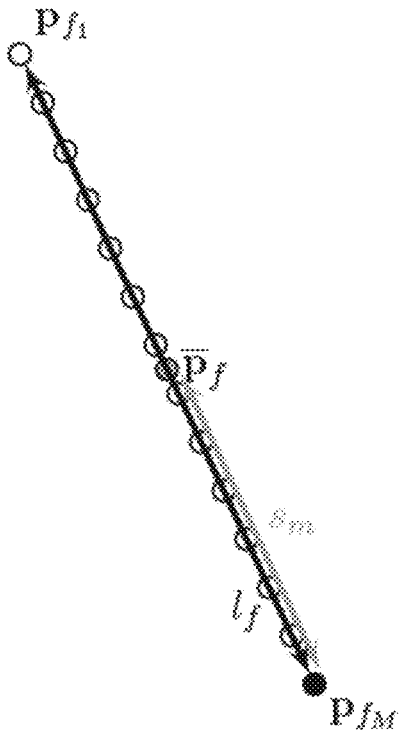
FIGS. 5 and 6 show an illustration for explaining circularity.
Figure 6:
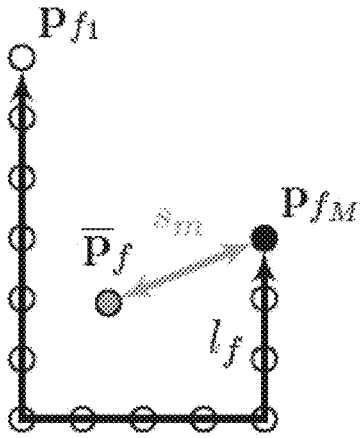

Since a typical behavior pattern in the case of parking space-seeking vehicles describes a circular selection of the course (e.g. by circling around a block), this feature intends to acquire the circularity κ of the journey within the feature window. Here, the reference variable is the distance $s_m$ of the current position $p_M$ from the centroid of the waypoints $p_f$. If $s_m \approx l_f/2$, a straight-line route can be assumed (FIG. 5). As this distance decreases, the course becomes more circular (FIG. 6).

The centroid of the journey is calculated by the arithmetic mean of the individual components of the positions in the feature window:

$$\overline{p}_f = \frac{1}{M}\sum_{k=1}^{M} p_{fk} \tag{3.9}$$

The value for the circularity is calculated by:

$$\kappa_i = 1 - \frac{\overline{\delta(\overline{p}_f, p_{fM})}}{l_f}, \kappa_i \in [0, 1] \tag{3.10}$$

Here, the distance between the centroid and the current position is normalized by the effective size of the feature window in order to obtain a value between 0 and 1. In order to be able to assume a straight-line course for $\kappa \rightarrow 0$ and a circular course for $\kappa \rightarrow 1$, the normalized term is additionally subtracted from 1.

PCA Circularity

A further option for determining the circularity of the course uses PCA (principal component analysis, which is described in e.g. [1]) as an aid. If PCA is applied to the two-dimensional position vectors of a feature window, a relative value for the portion of the overall variance of the axes, described by $\lambda_1$ and $\lambda_2$, is obtained in addition to the two principal components which describe the mutually orthogonal axes with the highest variance of the individual waypoints. $\lambda_1$ corresponds to the relative variance portion of the axis with the highest variance, which is why $\lambda_1 \geq \lambda_2$.

Figure 7:
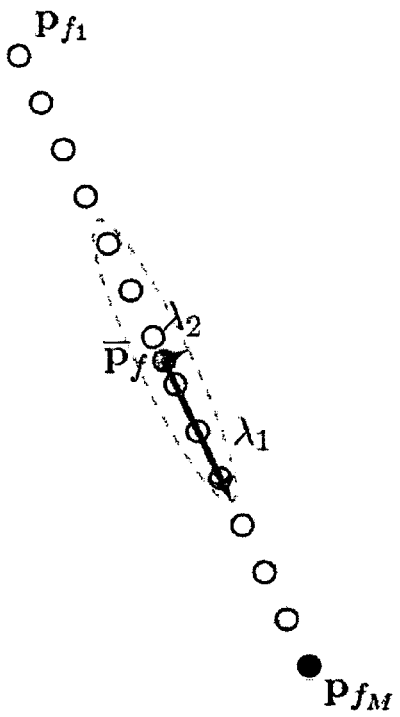
FIGS. 7 and 8 show an illustration for explaining PCA circularity.
Figure 8:
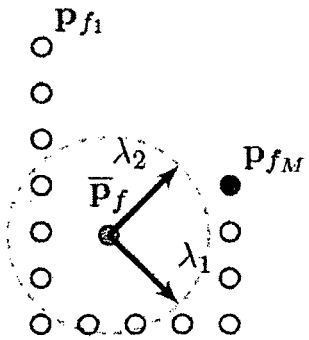

If the examined journey extends along a straight line, the whole variance of the waypoints is only distributed on the axis described by the first principal component (FIG. 7). Only a small portion of the overall variance was allotted to the axis of the second principal component. If the waypoints describe a completely circular course, the portion of the second principal component of the overall variance increases, and so $\lambda_1 \approx \lambda_2$ (FIG. 8).

In order to calculate the PCA circularity $\rho$, PCA is applied to the position information within a feature window. Subsequently, the ratio of the resultant scalars $\lambda_1$ and $\lambda_2$ is formed.

$$\rho_i = \frac{\lambda_2}{\lambda_1}, \rho_i \in [0, 1] \tag{3.11}$$

As a result of the restriction $\lambda_1 \geq \lambda_2$, the value of $\rho$ varies between 0 and 1, wherein $\rho_i \rightarrow 0$ denotes a straight-line course and $\rho_i \rightarrow 1$ denotes a circular course.

Change in Direction

Vehicles seeking a parking space often turn. On the basis of the current and a previous position it is possible to calculate the journey direction $\Phi_i$ in the form of an angle (0° to 359°, corresponding to the compass directions) for each journey data vector $x_i$. With the aid of $\Phi$, a value for the change in direction $\Delta_\Phi$, normalized to the traveled route $s_d$ between two waypoints, can be calculated:

$$\overline{\Delta}_{\phi,i} = \frac{\Delta_{\phi,i}}{\frac{\delta(p_i, p_{i-1})}{s_d}} \tag{3.12}$$

where $$\Delta_{\phi,i} = \min\{|\phi_i - \phi_{i-1}|, 360° - |\phi_i - \phi_{i-1}|\}.$$

In order to be able to calculate a meaningful value for the change in direction over the course of a journey, the arithmetic mean $\overline{\Delta}_{\Phi,i}$ is formed over all normalized changes in direction $\tilde{\Delta}_{0,fk}$ in the feature window:

$$\overline{\Delta}_{\phi,i} = \frac{1}{M}\sum_{k=1}^{M} \Delta_{\phi,fk} \tag{3.13}$$

Figure 9:
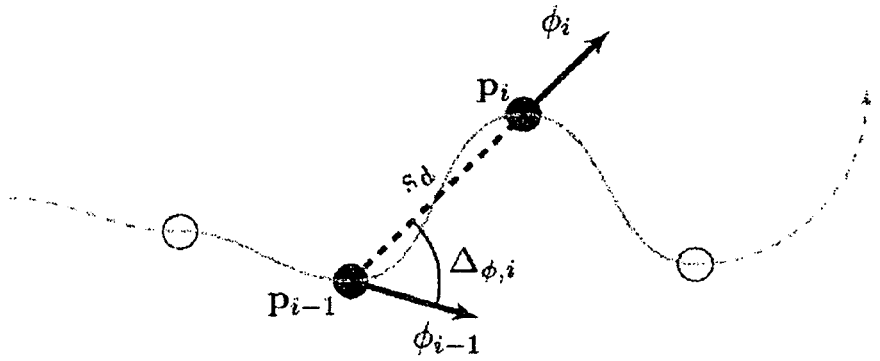
FIG. 9 shows an illustration for explaining a mean change in direction.
Figure 10:
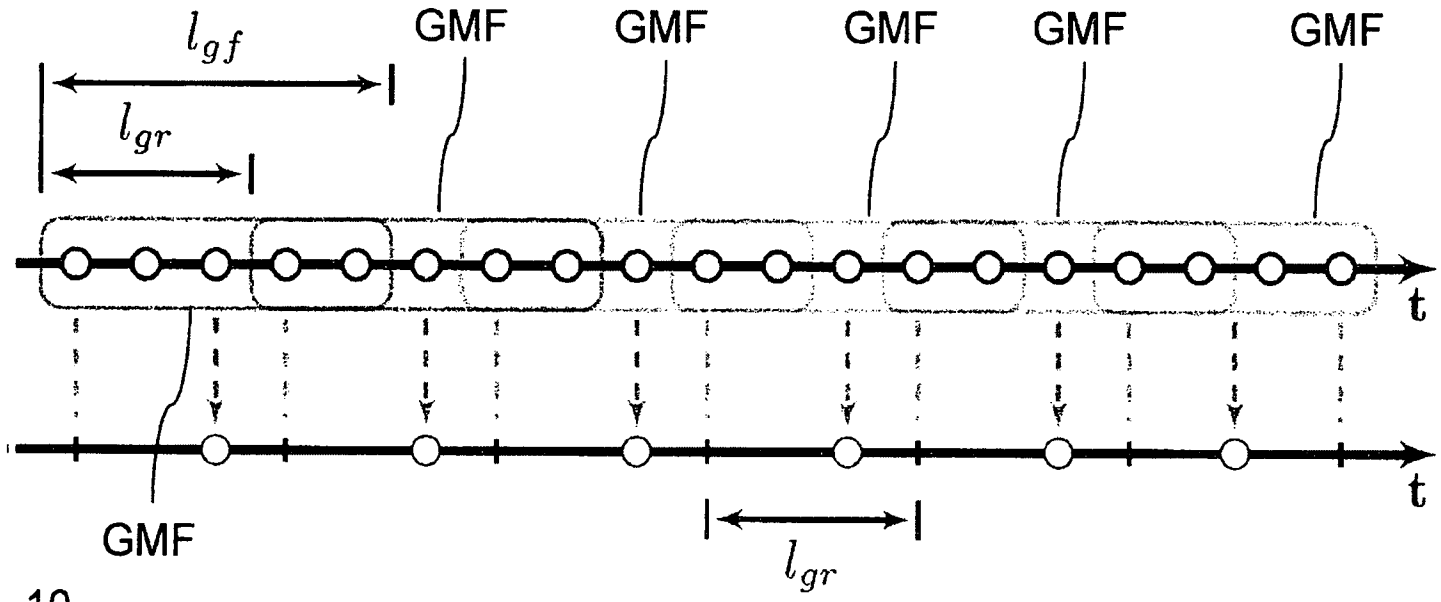
FIG. 10 shows a schematic illustration of smoothing of the processed data, undertaken within the scope of the method.

FIG. 9 shows journey directions $\phi_{i-1}$ and $\phi_i$ at the corresponding positions $p_{i-1}$ and $p_i$ and the difference $\Delta_{\Phi,i}$ thereof.

Target Inefficiency

This feature calculates the inefficiency of the course in relation to the target of the journey. During the journey, the target cannot be determined on the basis of the journey data, and therefore this feature can only be formed after the journey was completed (i.e. offline), when all journey data vectors are known. The position $p_N$ of the last journey data vector, which represents the location of the found parking space, is assumed as target position.

The inefficiency of the course in relation to the target $\zeta$ is calculated for each journey data vector as follows (cf. Eq. 3.7):

$$\zeta_i = \eta_k([p_1, p_2, \ldots, p_N]) \tag{3.14}$$

Since the start and end positions of a journey may be close together, for example in the case of courier journeys, a maximum target inefficiency is already present at the beginning of the journey. This can be worked around by virtue of the waypoint situated furthest away from the target $p_{i_d} = \arg\max_{p_i}\{\delta(p_i, p_N)\}_{i=1}^{N}$ being established from the target position and the value of the feature being set to 0 for $i < i_d$:

$$\eta_i = \begin{cases} 0 & i < i_d \\ \eta_i([p_1, p_2, \ldots, p_N]) & i \geq i_d \end{cases} \tag{3.15}$$

In the optional smoothing step (step S3), the feature vectors of a journey are smoothed. The purpose of the smoothing is to combine feature vectors in a specific journey section to form a smoothed feature vector. In this manner, it is no longer single waypoints but route sections that are processed. Smoothed feature vectors are produced by combining a plurality of feature vectors $m_i$, which are situated within a smoothing window GMF. The smoothing window GMF is advanced in relation to the traveled route and may overlap itself. This is depicted in FIG. 11.

The length of a respective smoothing window GMF is determined by $l_{gf}$. It is anchored at the first feature vector $m_{g1}$ of a route section. The feature vector $m_{gR}$ at the end of the route section is the last subsequent feature vector which has a distance of less than $l_{gf}$ from $m_{g1}$ in relation to the traveled route. The number of feature vectors $m_i$ within a smoothing window GMF may vary analogously to the number of journey data vectors $x_i$ within a feature window $MF_i$. To allow the smoothing windows MGF to overlap, a new smoothing window MGF can be anchored after exceeding a specific distance $l_{gr}$ within the current smoothing window MGF. So that it is never the case that more than two smoothing windows overlap at the same time, in order to restrict the complexity of this step, the following applies:

$$l_{gr} \leq l_{gf} \leq 2 \cdot l_{gr} \tag{3.16}$$

Each smoothed feature vector produced by the feature vectors in a smoothing window MTF characterizes a route section with the length $l_{gr}$, which starts at the position of the first included feature vector and ends at the position of the first feature vector of the next smoothing window. The corresponding route section of the last smoothed feature vector of a journey can be shorter or longer.

What this ensures is that all route sections represented by smoothed feature vectors of a journey are disjoint, with the smoothing windows not necessarily having to be disjoint amongst themselves. As a result, feature vectors of the subsequent route section can also be included when calculating a smoothed feature vector $m_g$ which characterizes a specific route section. In order to prevent this, it is possible to select $l_{gf}=l_{gr}$.

The individual components of the smoothed feature vector are calculated as follows from the R feature vectors in the smoothing window $[m_{g1}; \ldots; m_{gR}]$:

$$m_g = \lfloor \underset{\hat{m}=m|\bar{v}}{\text{median}}\{\bar{v}_{g1}, \ldots, \bar{v}_{gR}\}, \max\{\hat{m}_{g1}, \ldots, \hat{m}_{gr}\} \rfloor, \tag{3.17}$$

The average speed corresponds to the median of the average speeds of all feature vectors, while the maximum of all other features is established.

If, additionally, the label c for the affiliation to a traffic class is known for the feature vectors in the smoothing window, the median of all labels is established for the corresponding label in the smoothed value. This therefore corresponds to a majority decision, with a decision being made in favor of parking space-seeking traffic in the case of an equal number of votes. In the special case of $l_{gf}=l_{gr}=0$, the smoothing has no effect: the smoothed feature vectors then correspond to the original feature vectors.

In the classification step (step S4), the produced feature vectors are considered individually and classified in relation to the traffic classes terminating traffic Z and parking space-seeking traffic P. At the end of this step, a probability $p(P|m_i)$ is available for each feature vector $m_i$, specifying the probability of a feature vector belonging to the parking space-seeking traffic.

In order to calculate this probability, the feature vectors are normalized first, reduced and subsequently classified. Training data in the form of feature vectors are required for all these partial steps in order to be able to learn the parameters for the individual partial steps. Monitored learning processes are used within the scope of this method. Therefore, the class affiliation of the individual feature vectors, in the form of the true label c, must be known. This is made possible by using test journeys recorded for learning purposes, during which the traffic class is known at all times.

The training data are available in the form of an N×K matrix T, wherein each row represents a feature and each column represents a feature vector, cf. FIG. 11. FIG. 11 shows a training matrix T. The rows of the matrix represent the different features while the columns represent the manifestation thereof in a feature vector. According to the class affiliation of the feature vectors, the training data in T can be subdivided into two matrices $T_Z$ and $T_P$.

Different features have different value ranges. So that features with numerically higher value regions do not dominate over features with numerically smaller value ranges and in order to make the feature values more comparable, the features are normalized. The effect thereof is that both features with a large value range and features with a small value range are imaged onto the same value range.

In order to calculate normalized feature values, use is made of z-normalization, which is known to a person skilled in the art. Here, the mean value $\mu_n$ and the standard deviation $\sigma_n$ are established for each individual feature $m_n$ on the basis of training data in T.

$$\mu_n = \frac{1}{K}\sum_{k=1}^{K} m_{n,k} \tag{3.18}$$

$$\sigma_n = \sqrt{\frac{1}{K-1}\sum_{k=1}^{K}(m_{n,k}-\mu_n)^2} \tag{3.19}$$

In order to calculate the entries $\tilde{m}$ of the normalized training matrix $\tilde{T}$, each entry of the training matrix is transformed with the aid of the calculated parameters:

$$\tilde{m}_{n,k} = \frac{m_{n,k}-\mu_n}{\sigma_n} \tag{3.20}$$

A column of the resultant therefore contains a normalized feature vector $\tilde{m}$.

The background for the feature reduction lies in the reduction of the feature components in a feature vector with minimal information losses. Here, the number of features in $\tilde{m}$ is reduced from N to $1 \leq D < N$. Thus, a vector projection $\square^N \rightarrow \square^D$ is carried out. The reduced feature vector $\tilde{m}$ is calculated with the aid of the N×D transformation matrix W:

$$\hat{m} = W\tilde{m} \tag{3.21}$$

The preferably employed technique for reducing features is principal component analysis (PCA), in which there is a reduction N→D. Principal component analysis is an unmonitored process for reducing features. It pursues the target of finding those main axes in the feature space on which the feature vectors imaged thereon achieve maximum variance.

The basis for calculating the transformation matrix is the N×N covariance matrix Σ of the training matrix T, consisting of the entries $\sigma_{i,j}$.

$$\sigma_{i,j} = \frac{1}{M}\sum_{k=1}^{M}(\tilde{m}_{n=i,k}-\mu_{n=k})(\tilde{m}_{n=j,k}-\mu_{n=j}) \tag{3.22}$$

Subsequently, the eigenvectors and eigenvalues of the covariance matrix are calculated, as is described in e.g. [3]. The eigenvectors $w_i$ represent axes in the feature space, while the eigenvalues $\lambda_1$ specify the relative portion of the overall variance of the feature vectors projected onto the resulting eigenvectors. $w_1$ corresponds to the eigenvector with the largest eigenvalue $\lambda_1$, while $w_N$ represents the eigenvector with the smallest eigenvalue $\lambda_N$. If the eigenvectors are known, it is now possible to select any $1 \leq D < N$, which means the dimension of the transformed features. The D lines of the transformation matrix are then filled with the first D eigenvectors $[w_1; \ldots; w_D]$.

$$W = \begin{pmatrix} w_1 \\ \vdots \\ w_D \end{pmatrix} \tag{3.23}$$

The transformation of a feature vector m into the reduced feature space is applied by $$\hat{m} = W(m - \mu) \tag{3.24}$$

where μ denotes the mean value vector with the mean values of the individual features $[\mu_1; \ldots; \mu_N]$. If the feature vectors have already been freed from a mean value (μ=0) by way of a preceding normalization, the transformation can also be carried out in accordance with the prescription in equation 3.21.

As a result of the classification, each (reduced) feature vector is assigned a probability. On the basis of this probability, it is possible to make a statement about the class affiliation c of a feature vector. Here, $c_Z$ denotes the affiliation to the class "terminating traffic" while $c_P$ denotes the affiliation to the "parking space-seeking traffic".

In order to calculate the probability of a feature vector belonging to the parking-space-seeking-traffic traffic class, which is also referred to as a posteriori probability, use is made of the well-known Bayes' Theorem, which is described in e.g. [1] or [2].

$$p(c_P \mid \hat{m}) = \frac{p(\hat{m} \mid c_P)p(c_P)}{p(\hat{m})} = \frac{p(\hat{m} \mid c_P)p(c_P)}{\sum_{c \in \{c_Z, c_P\}} p(\hat{m} \mid c)p(c))} \tag{3.27}$$

$p(\hat{m}|c)$ is the class-specific density function, which specifies the probability that a feature vector belongs to the class c. p(c) is denoted the a priori probability and represents the probability with which the class c occurs. Finally, $p(\hat{m})$ specifies the probability of the occurrence of a feature vector, without distinguishing according to class. It can be calculated by summing all class-specific probabilities, multiplied by the occurrence probability of the corresponding class.

The density functions of probabilities required to calculate the a posteriori probability can be estimated on the basis of the training data in T or $T_Z$ and $T_P$:

In order to be able to estimate the class-specific density functions, the assumption is made that the individual components of the feature vectors within the various classes have a normal distribution. As a result of this assumption, the values for $p(\hat{m}|c)$ are to be calculated on the basis of the density function for the normal distribution, which is defined by the parameters mean value μ and covariance matrix Σ.

$$p(\hat{m}) = \frac{1}{(2\pi)^{\frac{p}{2}} |\Sigma|^{\frac{1}{2}}} e^{-\frac{1}{2}(\hat{m}-\mu)^T \Sigma^{-1} (\hat{m}-\mu)} \tag{3.28}$$

Here, μ is calculated in accordance with the average value in the normalization step and Σ is calculated in accordance with the covariance matrix of the PCA. The training data in $T_Z$ and $T_P$ subdivided according to class serve as data basis for calculating the parameters of the class-specific density functions. Consequently, $p(\hat{m}|c_Z) = \aleph(\mu_Z, \Sigma_Z)$ and $p(\hat{m}|c_z) = \aleph(\mu_P, \Sigma_P)$.

The number of feature vectors in the training data is used to estimate the a priori probability of the different classes. Here, N denotes the number of feature vectors in T and $N_P$ denotes the number of feature vectors in the class-specific training matrices $T_Z$ and $T_P$.

$$p(c_Z) = \frac{N_Z}{N},\ p(c_P) = \frac{N_P}{N},\ \text{where} \sum_{c \in \{c_Z, c_P\}} p(c) = 1 \tag{3.29}$$

With the aid of the a posteriori probability it is now possible to make a statement about the classification of a feature vector, since $p(c_Z|\hat{m}) = 1 - (c_P|\hat{m})$. The employed classifier is a maximum a posteriori classifier. This means that a feature vector is classified on the basis of the largest a posteriori probability:

$$c_{MAP} = \arg \max_{c \in \{c_Z, c_P\}} \{p(c \mid \hat{m})\} = \begin{cases} c_P & p(c_P \mid \hat{m}) > \frac{1}{2} \\ c_Z & p(c_P \mid \hat{m}) \le \frac{1}{2} \end{cases} \tag{3.30}$$

The result of the classification also applies beyond the feature vector to the underlying journey data vector.

The profile of the decision function in the feature space is marked by the set M of those points in the feature space which lie on the decision boundary:

$$M = \{X \in R^D | p(c_P|x) = p(c_Z|x) = ½\} \tag{3.31}$$

The profile of the decision function, which is generated by the parametric classification presented here, is quadratic due to the selection of different covariance matrices.

The position of the decision boundary is influenced by the a priori probabilities. As the a priori probability of a class decreases, the decision boundary is shifted further in the direction of the corresponding class. Thus, the result of the classification can be influenced by adapting the number of feature vectors in each class.

Figure 12:
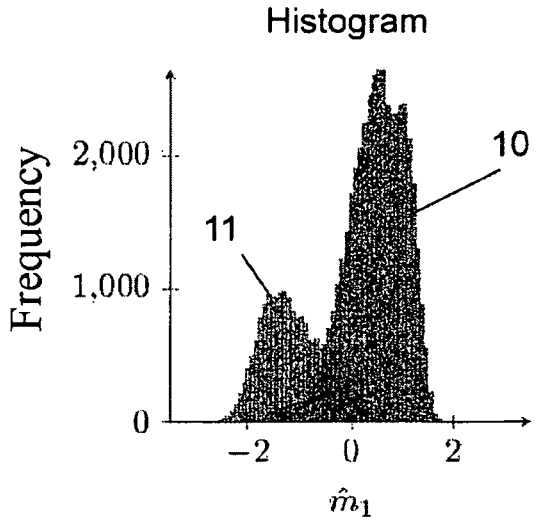
FIGS. 12, 13 and 14 show a histogram, the class density and resulting decision boundaries for establishing a probability for classifying the feature vectors.
Figure 13:
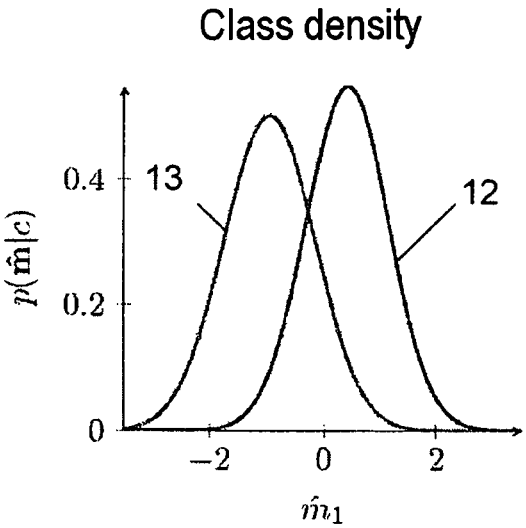
Figure 14:
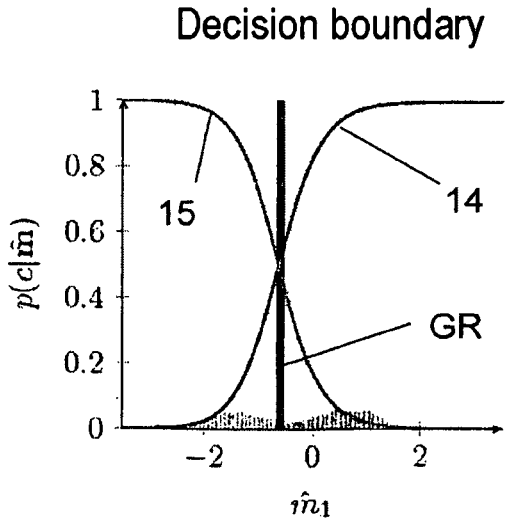

FIGS. 12 to 14 illustrate the construction of the decision boundary with the aid of the class-specific training data in the one-dimensional feature space. The graphic elements which were constructed with the aid of the feature vectors in $T_Z$ are denoted by 10, 12, 14, while the elements characterized by 11, 13, 15 were constructed on the basis of the feature vectors in $T_P$. In FIG. 14, the decision boundary is denoted by GR.

The object of the segmentation is to establish on the basis of the analysis of the time profile of the classification of feature vectors that journey data vector which marks the start of searching for a parking space. The result of the segmentation is a subdivision of the journey into two segments, corresponding to the traffic classes, which forms the basis for calculating the desired information in respect of intensity and localization of the parking space-seeking traffic.

If the time profile of the classification result $c_{MAP}$ is observed, the assumption is made that a transition of the classification result according to $c_Z \rightarrow c_P$ represents the start of the search for a parking space. Such a transition is referred to as a positive transition, while the reverse case $c_P \rightarrow c_Z$ is referred to as a negative transition.

In the ideal case, a positive transition only occurs once during a journey. However, reality (cf. FIGS. 15 to 17) shows that a number of positive transitions may occur during a journey.

If no positive transition occurs over the course of the whole journey, the last journey data vector is assumed to be the start of the search for a parking space. This ensures that a value>0 can be calculated for the parking space search duration and the parking space search distance.

Figure 15:
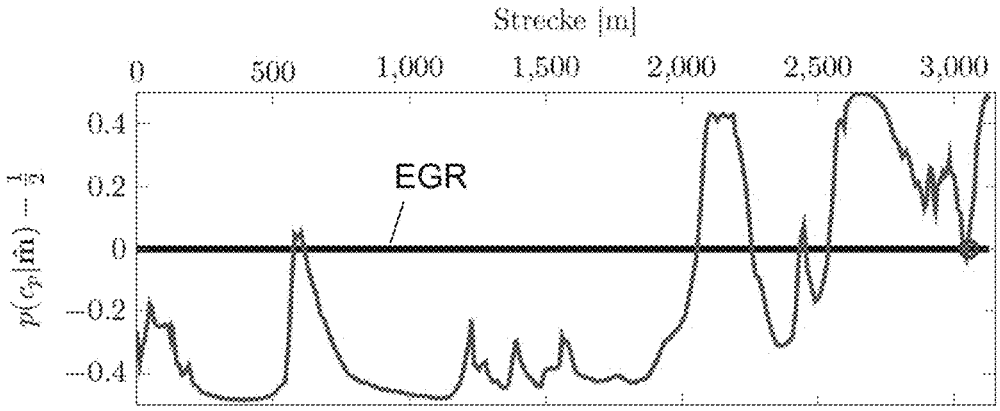
FIGS. 15, 16 and 17 show various alternatives for carrying out segmentation.
Figure 16:
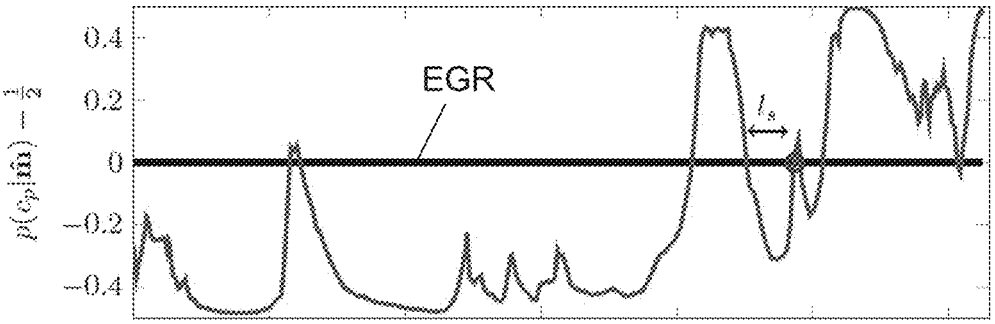
Figure 17:
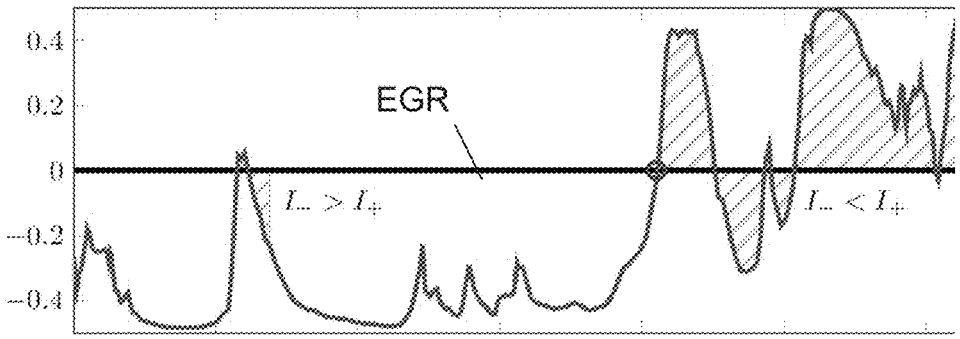

What is described below on the basis of FIGS. 15 to 17 are three processes which, at any time, establish at most one journey data vector $x_+$ with a positive transition of the classification result as the start of the search for a parking space. A journey data vector $x_-$ represents a journey data vector with a negative transition of the classification result.

The so-called simple segmentation process (FIG. 15) chooses the last positive transition (in time) provided that the classification result in the subsequent journey data vectors constantly remains as $c_P$. $x_+$ is discarded after a negative transition, and so no acquired start of the search is present after this time. This means that this process acquires parking space-seeking traffic at no time where $c=c_Z$.

The segmentation with a distance criterion (FIG. 16) expands the simple segmentation process to include a distance criterion. Here, an established journey data vector for $x_+$ is not immediately forgotten after a negative transition; instead, it is maintained for a certain distance $I_S$ after the negative transition. If a further positive transition is found within this distance, it is ignored and $x_+$ is kept. If no positive transition is found, $x_+$ is forgotten at the end of the route after the negative transition. If $I_S=0$, this segmentation process achieves the same result as a simple segmentation.

In addition to the information relating to the classification of a feature vector $c_{MAP}$, the segmentation depicted in FIG. 17 with an integral criterion also uses the a posteriori probability $p(c_P|\hat{m})$. Here, it is not only the hard decision as to whether or not a feature vector constitutes parking space-seeking traffic that is used to establish the start of the search, but also the reliability with which the decision was made.

If a positive transition is acquired with a new journey data vector $x_+$ when no start of the search is present, the integral $I_+$ of the profile of the a posteriori probability over the route s covered from $x_+$ to $x_-$ is calculated continuously until the next negative transition $x_-$ is found.

$$I_+=\int_{x_+}^{x_-} p(c_P|\hat{m})-\tfrac{1}{2}\partial s \tag{3.32}$$

Here, a value of 0.5 is subtracted from the a posteriori probability in order to obtain positive values for $c=c_P$ and negative values for $c=c_Z$. This decision boundary is characterized by EGR in FIGS. 15 to 17. Therefore, if this modified value of the a posteriori probability is integrated over a route with only a negative profile, a negative term is obtained. Moreover, this subtraction term ensures that route profiles with the same reliability of the classification but with a different classification result represent the same absolute integral value.

For the subsequent journey data vectors, which are classified by $c=c_Z$, the negative integral value $I_-$ is now calculated continuously until either $I_->I_+$ or a new positive transition is found. If $I_->I_+$, the current start of the search is forgotten, while merely the positive integral with $I_+=I_++I_-$ is recalculated in the case of a new positive transition.

This means that a strong enough terminating traffic behavior following a route portion with a parking space-seeking traffic behavior can revise the start of the search. On the other hand, the integral criterion ensures that a small terminating traffic behavior over a relatively long distance cannot lift the current start of the search.

Since the profile of the a posteriori probability does not follow any analytically calculable function and since, moreover, no continuous value profile is present, the integral in equation 3.32 must be approximated numerically for a route portion, represented by the positions $[p_1; p_2; \ldots; p_N]$ and the associated a posteriori probabilities $[p_{ap1}; p_{ap2}; \ldots; p_{apN}]$:

$$\hat{I}=\sum_{i=1}^{N-1}\left(p_{ap_i}-\frac{1}{2}\right)\delta(p_i, p_{i+1}) \tag{3.33}$$

The segmentation step provides a result in respect of the start of the search for a parking space. The result does not necessarily correspond to reality as it is supported by the result of the classification. The classification in turn is based on a probabilistic model which was created with the aid of training data.

The result of the segmentation is assessed in an optional plausibility check (step S6) and discarded where necessary. This means that this step provides the option of leaving journeys non-assessed in relation to the search for a parking space. The criteria for withholding the segmentation result include e.g. an implausibly long route while searching for a parking space. According to the assumed journey progress, it appears implausible that nearly an entire journey was spent searching for a parking space. Since it may be the case that the search for a parking space takes a relatively long time due to possible obstructions, this criterion is measured on the basis of the traveled route in the terminating traffic and in the parking space-seeking traffic. It is assumed that the result is implausible if the route $s_P$ traveled from the start of searching for a parking space to the target is greater than half the distance covered from the start of the journey to the start of the search $s_Z$:

$$\frac{s_Z}{2}-s_P\begin{cases}\geq 0 & \text{plausible}\\ <0 & \text{implausible}\end{cases} \tag{3.34}$$

LIST OF REFERENCE SIGNS $x_i$ Journey data vector (i=1 . . . N)
$c_i$ Class label/traffic class
i Number of a measurement
N Number
$m_i$ Feature vector
$c_Z$ First classifier
$c_P$ Second classifier
p Probability
$\tau_{park}$ Time from which a parking space is sought
ZV Terminating traffic
PSV Parking space-seeking traffic
$MF_i$ Feature window
$I_f$ Size of the feature window
GMF Smoothing window
$l_{gf}$ Length of the smoothing window
EGR Decision boundary
GB Decision boundary The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for operating a vehicle navigation device to navigate to an available parking space, the method comprising the following acts:

acquiring a plurality of journey data vectors each containing information about a speed, position data and a time of acquisition of the speed and the position data;

establishing a feature vector at each time of acquisition of the plurality of journey data vectors, wherein the information about a current and a previous journey data vector is processed, wherein the feature vector comprises as feature components at least one item of speed information and one item of path information;

classifying each feature vector, wherein a first traffic category, which represents a vehicle journey, or a second vehicle category, which represents parking space-seeking traffic, is assigned to each feature vector, and wherein a probability is established, which specifies the probability with which the first or the second traffic category is to be assigned to the feature vector;

segmenting the feature vectors over the time profile of the established traffic categories, wherein there is a subdivision of the journey from the start of a search for available parking spaces to the last acquisition of a journey data vector into two segments in accordance with the determined traffic categories of the feature vectors;

determining the start of the search based on a transition from a first of the two segments into a second of the two segments;

determining a parking rate based on the determined start of the search, the parking rate reflecting a number of searches started per unit time;

determining a probability of the available parking space based on the parking rate, and navigating the vehicle, via the vehicle navigation device, based on the determined probability of the available parking space.

2. The method as claimed in claim 1, wherein journey data vectors remain unconsidered in the determination of the start of the search if the information about the speed of the journey data vector is greater than a first threshold or less than a second threshold.

3. The method as claimed in claim 1, wherein the journey data vectors are processed within a feature window, which represents a predetermined route, for establishing a respective feature vector, wherein the feature window includes the journey data vectors from a current measurement to a first measurement which, on the traveled route, lies further back than the predetermined route.

4. The method as claimed in claim 1, wherein the feature vector comprises one or more of the following feature components as feature components in addition to the speed information and the path information:

information about circularity of the traveled route, information about PCA circularity of the traveled route, information about a change in direction, and information about a target inefficiency.

5. The method as claimed in claim 1, wherein the speed information is one of an arithmetic mean and a median of the average speeds of the journey data vectors considered for establishing a respective feature vector.

6. The method as claimed claim 1, wherein the path information is a path inefficiency specifying how inefficient the traveled route is by way of the ratio between the actually traveled route in view of the shortest route between the positions of two journey data vectors.

7. The method as claimed in claim 6, wherein the path inefficiency which is the maximum for the processed set of journey data vectors is processed for a feature vector as path information.

8. The method as claimed in claim 1, wherein the feature vectors are normalized for the purposes of classifying each feature vector.

9. The method as claimed in claim 8, wherein a z-normalization, in which the mean value and the standard deviation are established for each feature component and said feature components are transformed therewith, is used for calculating normalized feature components.

10. The method as claimed in claim 9, wherein the feature components are reduced by vector projection, in particular by applying a principal component analysis.

11. The method as claimed in claim 1, wherein the calculation of the probability of the classifier is carried out using Bayes' theorem.

12. The method as claimed in claim 1, wherein the start of the search is defined by a positive transition from the first traffic category to the second traffic category, wherein the journey data vector which is assigned to the second traffic category represents the start of the search.

13. The method as claimed in claim 12, wherein the last positive transition in terms of time from the first traffic category to the second traffic category is selected as start of the search as long as the classification result of the subsequent journey data vectors constantly comprises the second traffic category.

14. The method as claimed in claim 12, wherein the last positive transition in terms of time from the first traffic category to the second traffic category is selected as start of the search as long as the classification result of the subsequent journey data vectors constantly comprises the second traffic category for a predetermined journey route.

15. The method as claimed in claim 12, wherein the start of the search is established on the basis of an integral of the profile of the probability over the traveled route.

16. A computer program product, comprising:

a non-transitory processor readable medium having processor executable code embodied therein to operate a vehicle navigation device to navigate to an available parking space, the processor readable medium having:

processor executable program code to acquire a plurality of journey data vectors each containing information about a speed, position data and a time of acquisition of the speed and the position data;

processor executable program code to establish a feature vector at each time of acquisition of the plurality of journey data vectors, wherein the information about a current and a previous journey data vector is processed, wherein the feature vector comprises as feature components at least one item of speed information and one item of path information;

processor executable program code to classify each feature vector, wherein a first traffic category, which represents a vehicle journey, or a second vehicle category, which represents parking space-seeking traffic, is assigned to each feature vector, and wherein a probability is established, which specifies the probability with which the first or the second traffic category is to be assigned to the feature vector;

processor executable program code to segment the feature vectors over the time profile of the established traffic categories, wherein there is a subdivision of the journey from the start of a search for available parking spaces to the last acquisition of a journey data vector into two segments in accordance with the determined traffic categories of the feature vectors;

processor executable program code to determine the start of the search based on a transition from a first of the two segments into a second of the two segments;

processor executable program code to determine a parking rate based on the determined start of the search, the parking rate reflecting a number of searches started per unit time;

processor executable program code to determine a probability of the available parking space based on the parking rate; and processor executable program code to navigate the vehicle, via the vehicle navigation device, based on the determined probability of the available parking space.

* * * * *